US012121137B2

(12) United States Patent
Bachman

(10) Patent No.: US 12,121,137 B2
(45) Date of Patent: Oct. 22, 2024

(54) UNIVERSAL HOLSTER AND METHOD OF ADJUSTING SAME

(71) Applicant: Mystery Ranch, Ltd., Bozeman, MT (US)

(72) Inventor: John Bachman, Belgrade, MT (US)

(73) Assignee: MYSTERY RANCH, LLC, Austin, TX (US)

( * ) Notice: Subject to any disclaimer, the term of this patent is extended or adjusted under 35 U.S.C. 154(b) by 0 days.

(21) Appl. No.: 18/485,994

(22) Filed: Oct. 12, 2023

(65) Prior Publication Data

US 2024/0164510 A1 May 23, 2024

Related U.S. Application Data

(60) Provisional application No. 63/427,036, filed on Nov. 21, 2022.

(51) Int. Cl.
*A45F 5/02* (2006.01)
*A45F 5/00* (2006.01)

(52) U.S. Cl.
CPC ..... *A45F 5/00* (2013.01); *A45F 2200/0516* (2013.01)

(58) Field of Classification Search
CPC ..... A45F 2200/0516; A45F 5/00; A45F 5/02; A45F 2200/0525; A45F 2200/0508; Y10S 224/93
USPC ..... 224/930
See application file for complete search history.

(56) References Cited

U.S. PATENT DOCUMENTS

| | | | | |
|---|---|---|---|---|
| 4,263,951 | A | 4/1981 | Siegel | |
| 6,129,254 | A | 10/2000 | Yu | |
| 6,244,400 | B1 | 6/2001 | Bowers | |
| 6,364,187 | B1 | 4/2002 | Castellano et al. | |
| 6,412,674 | B1 * | 7/2002 | Lipke | A45C 7/00 224/675 |
| 7,124,921 | B1 | 10/2006 | Hubbell | |
| 7,673,777 | B2 | 3/2010 | Gleason, Jr. | |
| 8,561,866 | B2 | 10/2013 | Gleason, Jr. | |
| 8,950,644 | B2 | 2/2015 | Gleason, Jr. | |
| 9,693,623 | B2 * | 7/2017 | Bryant | A45F 5/021 |
| 2007/0272719 | A1 | 11/2007 | Laughton | |
| 2014/0263520 | A1 | 9/2014 | Hamilton | |
| 2016/0360870 | A1 | 12/2016 | Langenwalter et al. | |
| 2018/0235351 | A1 * | 8/2018 | Caldwell | H04B 1/385 |

OTHER PUBLICATIONS

International Search Report and Written Opinion for PCT/US2023/080650, Mar. 22, 2024, 13 pages, U.S. Patent and Trademark Office.

* cited by examiner

*Primary Examiner* — Adam J Waggenspack
(74) *Attorney, Agent, or Firm* — Husch Blackwell LLP

(57) ABSTRACT

A universal holster device is provided for holding various items or devices. The holster device is adjustable between different sized configurations to hold different sized items. The adjustment of the holster device is made using a hook and loop fastener configuration in the back pocket of the holster device such that the hook and loop fastener cannot be pulled apart as normally used. Instead, an adjuster device must be slid into the back pocket to separate the hook and loop fastener and allow a user to adjust the holster device to the desired size configuration.

20 Claims, 11 Drawing Sheets

UNIVERSAL HOLSTER AND METHOD OF ADJUSTING SAME

CROSS-REFERENCE TO RELATED APPLICATIONS

This application claims priority to U.S. Provisional Patent Application Ser. No. 63/427,036, filed on Nov. 21, 2022, to John Bachman, entitled "Universal Holster and Method of Adjusting Same," the entire disclosure of which is incorporated herein by reference.

BACKGROUND OF THE INVENTION

Holster devices have been used for many years to hold and carry items. Holster devices can provide several benefits when holding or carrying items, including protecting the items, making the items easier to carry or transport, or restraining or securing the items.

To experience the full benefits of using a holster device to hold or carry an item, the holster device must be appropriately sized for the item. This can cause issues when users have a need for several different items of varying sizes. Typically, the solution is for a user to have separate holster devices appropriately sized and configured for each separate item. This is inefficient because it requires users to have a holster device for each item. Moreover, in some instances a holster device is attached to another carrying device, such as a backpack, belt, clothing, storage container, or similar gear, and consequently, switching items requires removing and affixing a new holster to the carrying device, which is inconvenient for the user. For example, some users, such as first responders, have a need to carry different items depending on the type of incident they are responding to. Consequently, if those items cannot be held by the same holster device that the user is already wearing or otherwise has prepared, the user must take time to find a new holster and swap it out. If a single holster can carry different items of varying sizes, the user can more efficiently switch out items while using a single holster which may or may not be further affixed to other gear, including possibly their clothing.

Accordingly, a need exists for a universal holster device that allows the user to carry items of varying sizes and shapes while still providing a snug fit to the item so that the standard benefits of a holster device are achieved. A further need exists for the user to be able to selectively adjust the universal holster device in an easy and efficient manner.

BRIEF SUMMARY OF THE INVENTION

The present invention is directed generally to a universal holster device for adjustably holding items of various sizes. The universal holster device can be configured to selectively adjust the effective size of a main cradle that the item is received in. In particular, adjustments can be made to the positioning of a connected bottom and back panel to change the effective height of the main cradle.

In one embodiment, the adjustable holster device includes a front panel, an intermediate panel, a back panel, a back pocket configured for receiving the back panel and at least a portion of the intermediate panel. The intermediate panel may be made up of a first intermediate panel portion and a second intermediate panel portion. The back panel may be connected to and extend from the second intermediate panel portion. A lateral flex line may be provided between the first intermediate panel portion and the second intermediate panel portion. A lateral flex line may also be provided between the intermediate panel and the back panel. Each lateral flex line may be constructed such that it is more flexible than a remainder of the intermediate panel or back panel, and may be in the form of a relief such in or adjacent to the intermediate panel such that the intermediate panel is thinner at the lateral flex line than it is in the areas adjacent to the lateral flex line. A cradle can be at least partially defined by the intermediate panel and may be adapted for receiving at least one of the objects. One or more visible markings or lines may be provided on the intermediate panel and/or back panel to indicate to a user where the intermediate panel and/or back panel should be aligned with respect to another portion of the adjustable holster device to achieve a certain configuration of the cradle.

A fastener may secure at least the back panel in place in order to define a size, e.g., height, of the cradle. The fastener can include a first fastening member attached to the back panel and second fastening member attached within the back pocket. In one embodiment, the fastener is a hook and loop fastener having a hook member and a loop member, and the first fastening member is one of the hook member and the loop member and the second fastening member is the other of the hook member and the loop member. The adjustable holster device can include an adjuster sheet configured to be selectively insertable between the hook member and the loop member to effect separation thereof and to permit the back panel to be selectively movable within the back pocket. The adjuster sheet can be a thin sheet made of a rigid or semi-rigid material. When the first and second fastening members are not fastened together, the back panel is configured for being selectively movable relative to (in and out of) the back pocket. When the first and second fastening members are fastened together, the back panel is held in a fixed location within the back pocket. The size, e.g., height, of the cradle is adjustable by moving the back panel relative to the back pocket.

In order to adjust a height of the cradle of the adjustable holster device, the adjuster sheet may be inserted between the hook member and the loop member to interrupt an attachment therebetween. Once separated, the back panel and/or intermediate panel can be selectively movable relative to the back pocket thereby lengthening or shortening a bottom portion of the cradle. The back panel and/or intermediate panel may be positioned so as to locate the back panel and/or intermediate panel to a specific position that corresponds to a configuration of the adjustable holster device that generally conforms to an object to be held by the adjustable holster device. Once in the desired position, the adjuster sheet is removed from between the hook member and the loop member allowing the hook member and the loop member to reattach together.

In further embodiments, the adjustable holster device can include side panels. Each side panel can have a first side panel portion and a second side panel portion, which may selectively overlap one another. An additional fastener may be provided, wherein a first fastening member of the fastener is attached to the first side panel portion and a second fastening member is attached to the second side panel portion. When the first and second fastening members are separated from one another, the second side panel portion is configured for being selectively movable to overlap a larger or smaller area of the first side panel portion, or vice versa, in order to adjust a depth of the cradle.

Objects and advantages pertaining to the universal holster device and its adjustment may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DESCRIPTION OF THE SEVERAL VIEWS OF THE DRAWING

In the accompanying drawings, which form a part of the specification and are to be read in conjunction therewith in which like reference numerals are used to indicate like or similar parts in the various views.

DETAILED DESCRIPTION OF THE INVENTION

Figure 1:
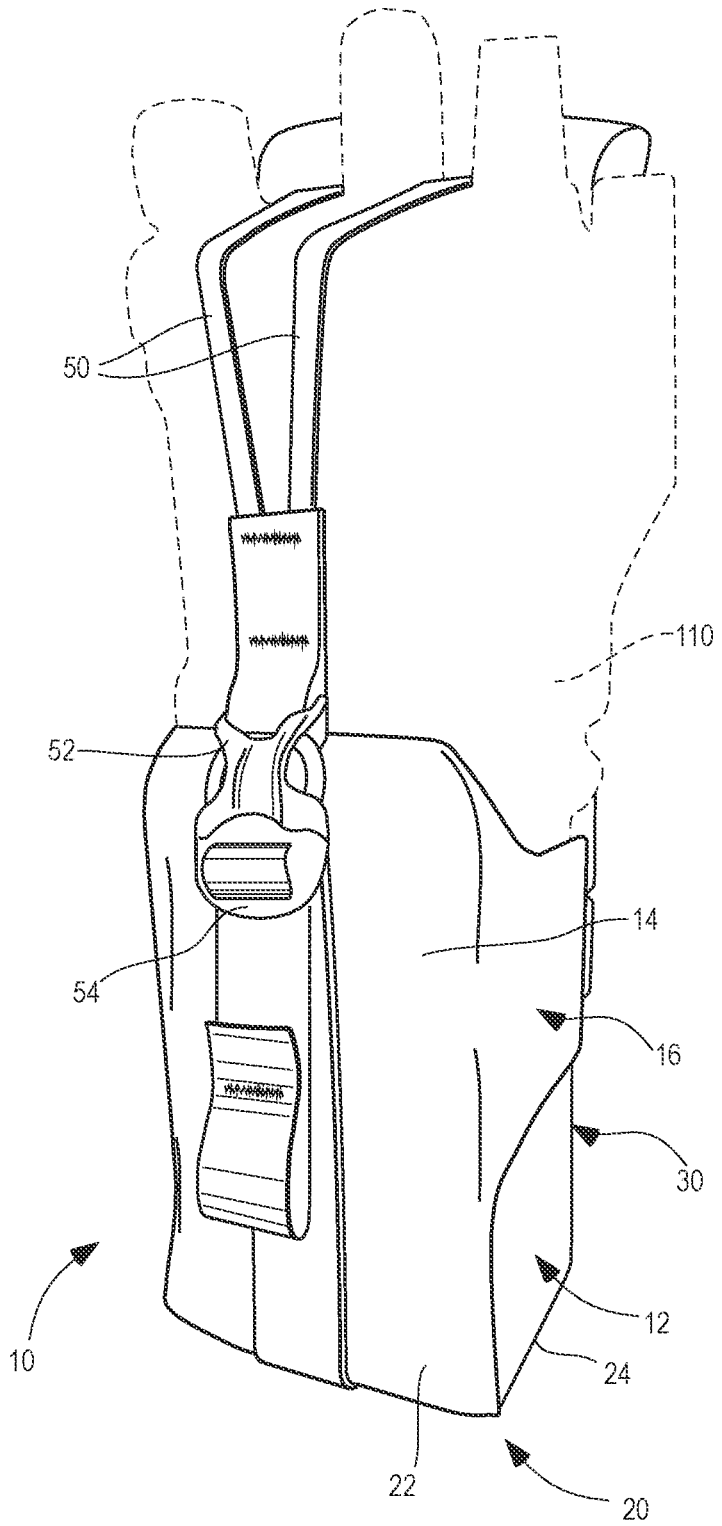
FIG. 1 is a perspective view of a universal holster device holding a radio device in accordance with an embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures. It will be appreciated that any dimensions included in the drawing figures are simply provided as examples and dimensions other than those provided therein are also within the scope of the invention.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is directed generally to a universal holster device 10 as illustrated in the various figures. The holster device 10 may include an adjustable envelope, pocket, or cradle 12 adaptable such that the holster device 10 can accommodate items of various sizes, including various heights, widths, depths, and/or volumes. One embodiment of the invention is adapted for holding a two-way radio 110. As discussed in further detail below, the device 10 is designed to adjust so that it can hold, for example, radios of various heights, including both a short radio 112 and a tall radio 114. It will be appreciated that such short and tall radios 112 and 114 may differ in size due to their differently-sized battery attachments and configurations.

While the holster device 10 is primarily described herein in connection with holding a radio 110, it will be appreciated the device 10 may be adapted to hold other items which come in a variety of sizes including, but not limited to, cellular phones, tablets, battery packs, liquid containers such as water bottles, medical equipment, firearms, or any other item, currently known or hereafter developed, that is suitable for being carried by the device 10. The universal holster device 10 provides several benefits when holding any of these items, including but not limited to protecting the items, making the items easier to carry or transport, or restraining or securing the items. As discussed below, the device 10 is designed to selectively adjust to receive and hold different-sized items while maintaining a its functionality and fit to each item.

Figure 2:
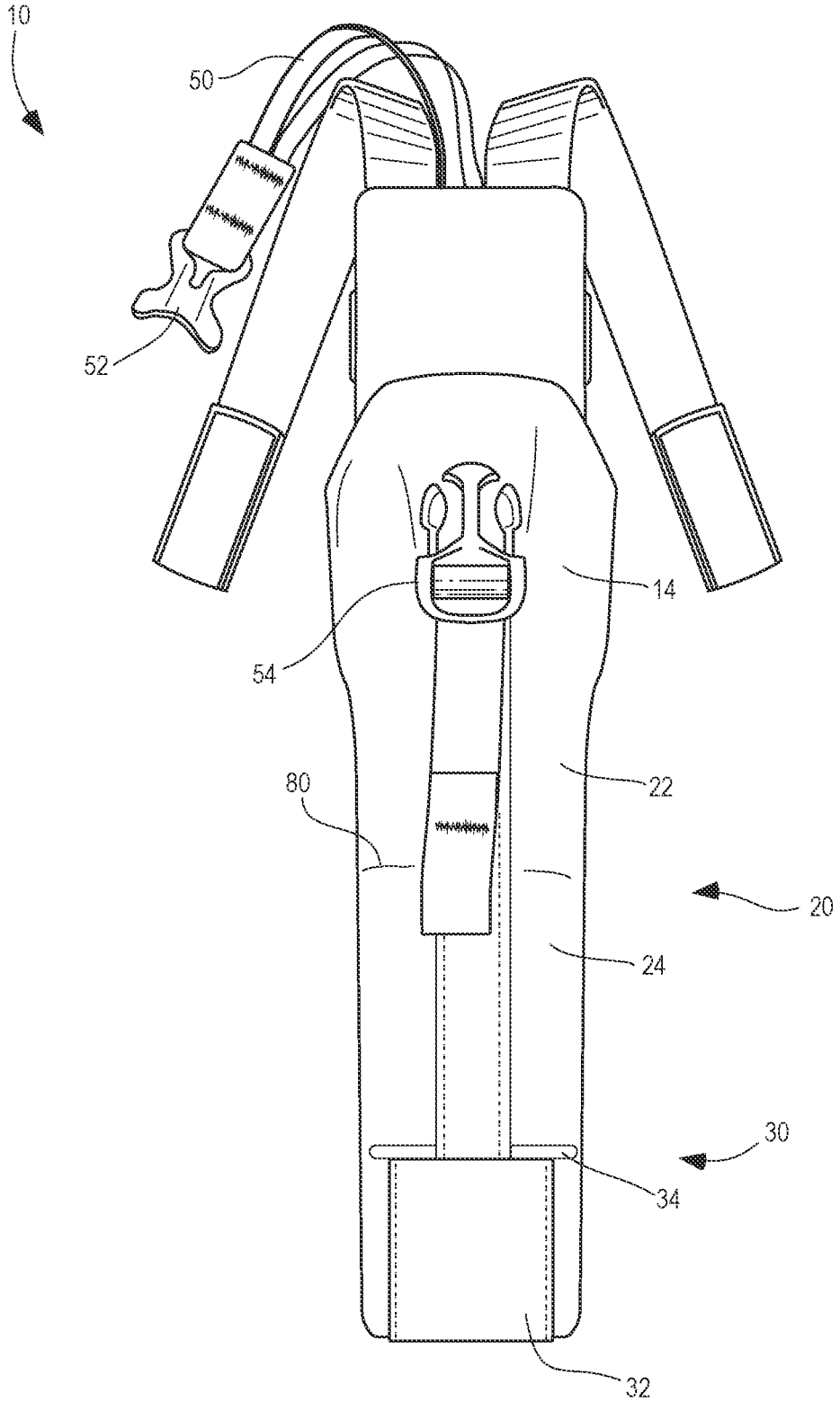
FIG. 2 is a front view of the universal holster device of FIG. 1, illustrating its bottom and back panels in an unfolded configuration.
Figure 3:
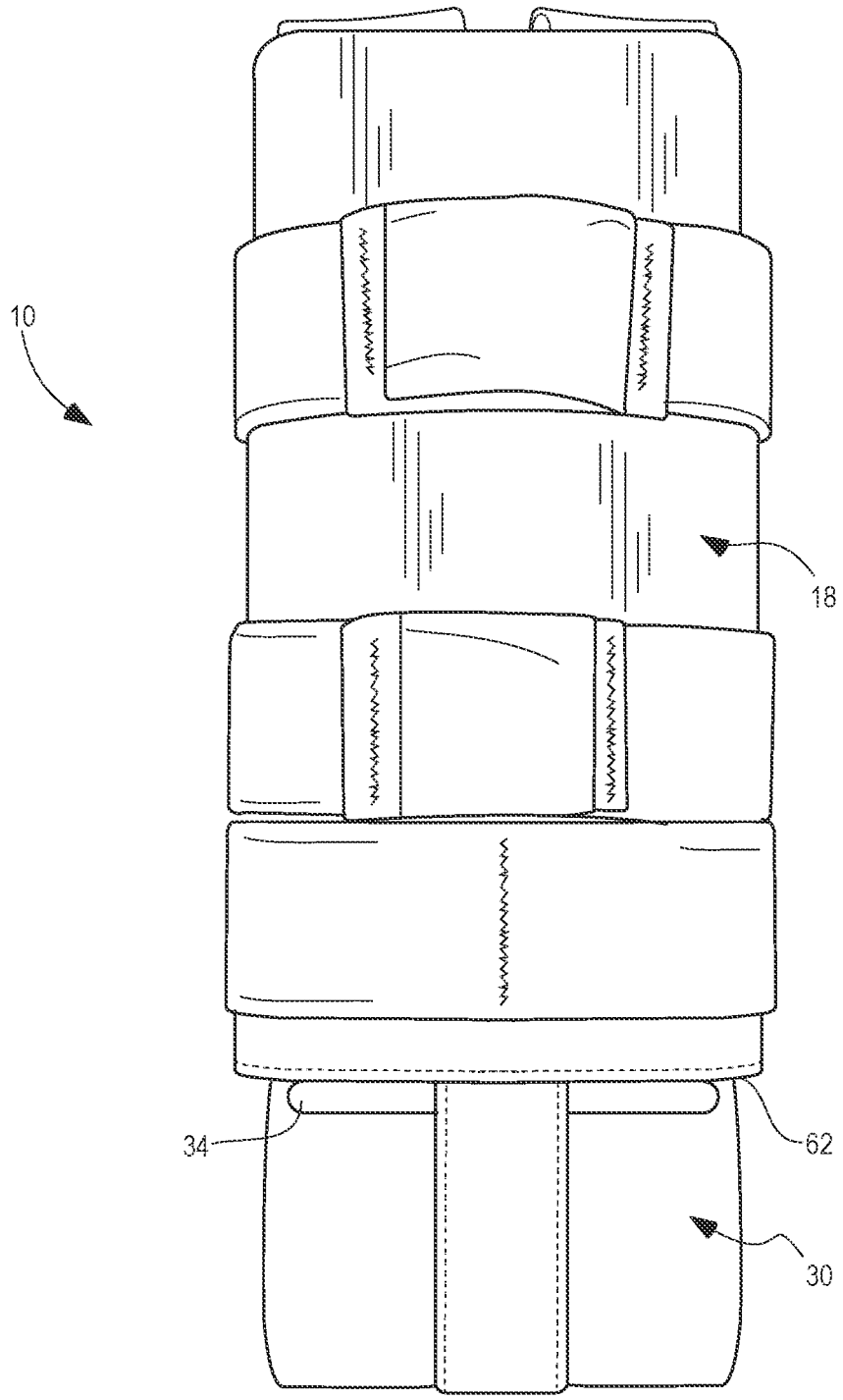
FIG. 3 is a rear view of the universal holster device of FIG. 1, illustrating its back panel as being at least partially received in a pocket opening.

Turning to the figures, FIGS. 1-3 illustrate the components of the device 10, including a front panel 14, a side panel 16, a back panel 18, and an adjustable intermediate panel 20, all of which may be constructed of, in whole or in part, flexible, semi-rigid, and/or rigid materials. Connected to the adjustable intermediate panel 20 is an adjustable back panel 30, which can have a first side or member of a hook and loop fastener 32 attached thereto. The device 10 may also be fitted with a top strap 50 and top strap connectors 52 and 54, which may be made of a buckle latch as shown in FIGS. 1 and 2, or any other fastening device including snaps, buttons, a hook and loop system, clasps, or any other suitable means for fastening. It will be appreciated that various components of the device 10 may be constructed, in whole or in part, of materials such as nylon, polyester, polypropylene, polyurethane, textiles, fiber-based fabrics, canvas, cloth, webbing, leather, or other suitable natural or synthetic materials currently known or hereafter developed. The various components of the device 10 may be sewn, welded, or otherwise suitably connected, fastened, or affixed together.

Figure 4A:
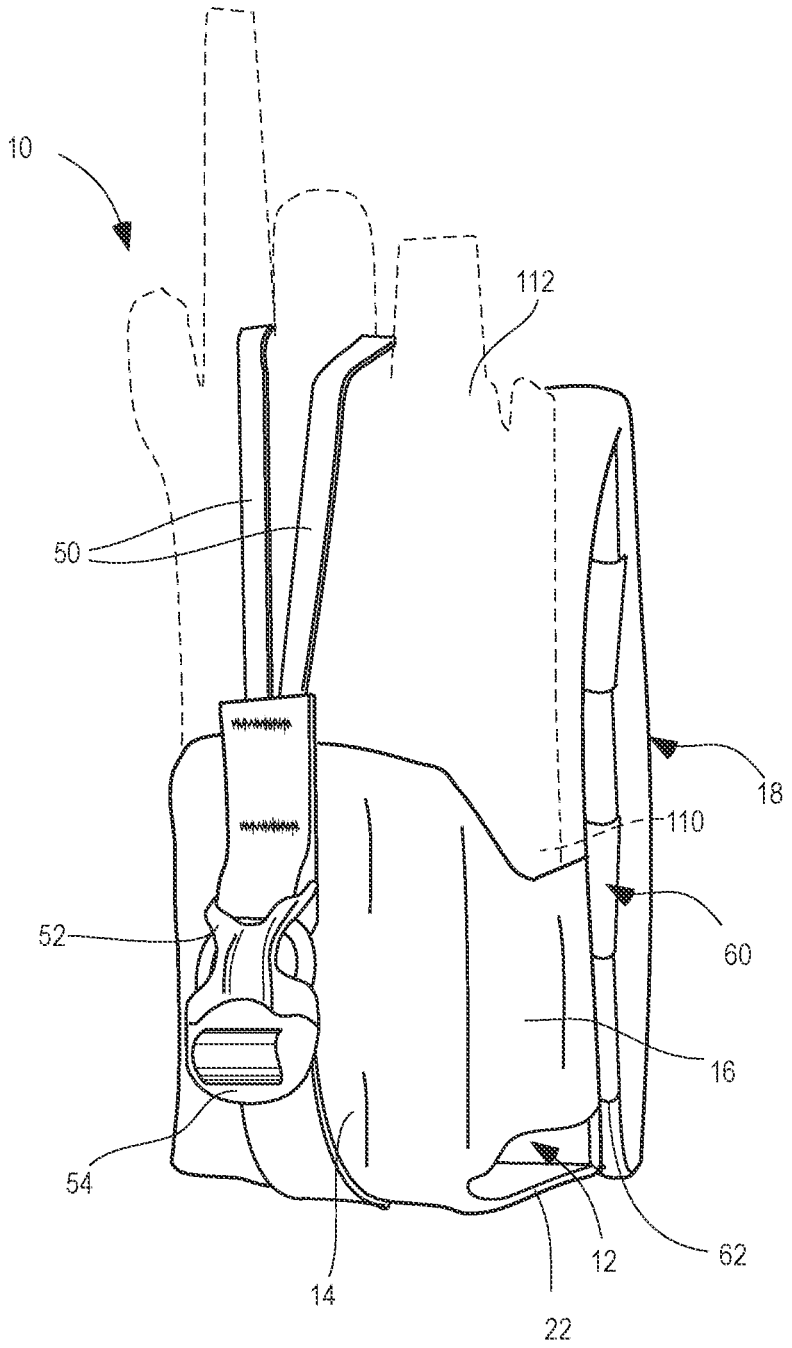
FIG. 4A is a perspective view of a universal holster device holding a short radio device in accordance with an embodiment of the present invention.
Figure 4B:
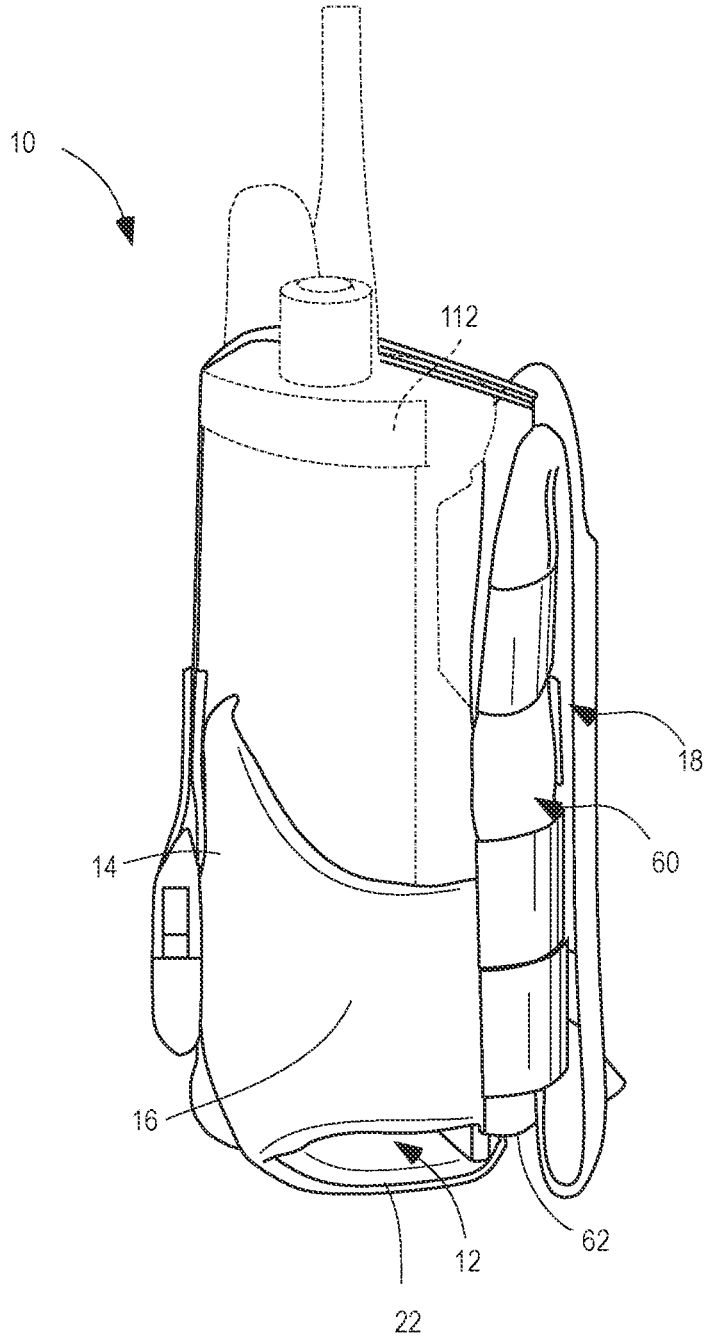
FIG. 4B is a side view of the universal holster device of FIG. 4A holding a short radio device.
Figure 6:
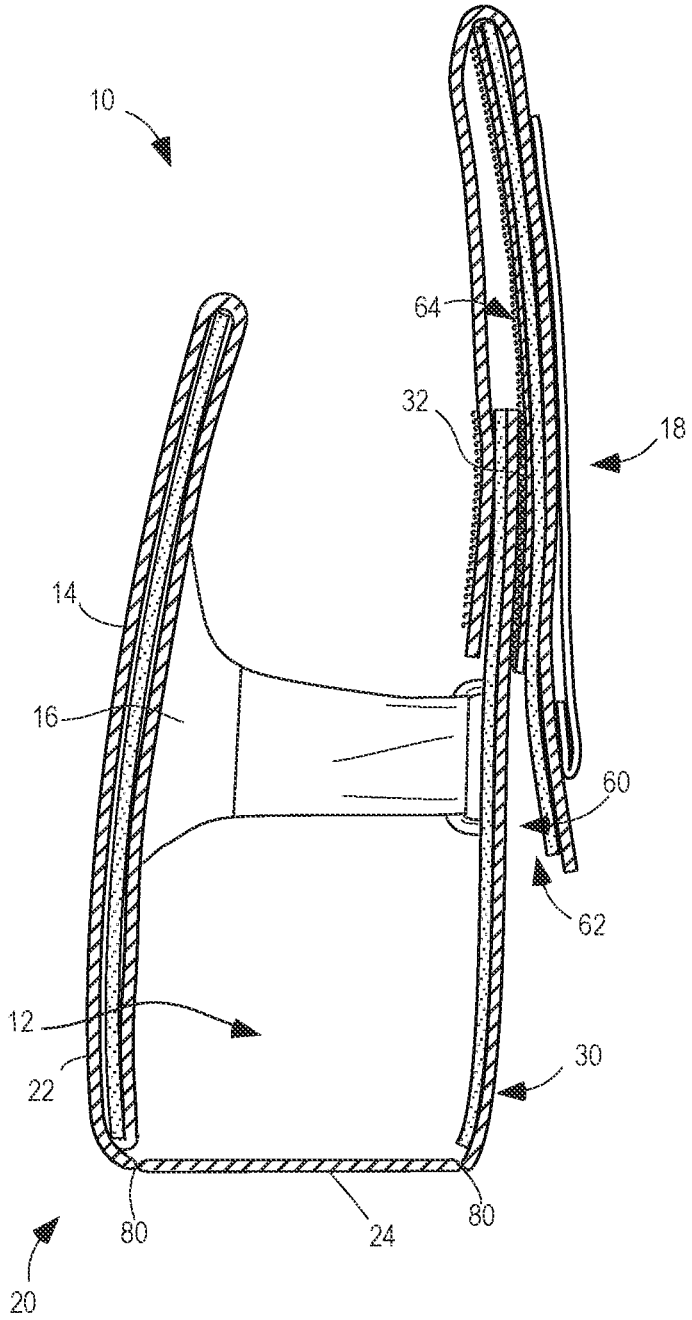
FIG. 6 is a sectional view of a universal holster device in accordance with an embodiment of the present invention.

As illustrated in FIGS. 4A and 4B, the device 10 can be placed in a first configuration wherein a short radio 112 can be held snugly in the device 10. As shown, in this first configuration, the adjustable back panel 30 has been fitted into a back pocket 60 by sliding the adjustable back panel 30 into a pocket opening 62 at the bottom of the back pocket 60. The first side of the hook and loop fastener 32 is then fastened to a second side or member of a hook and loop fastener 64 (as shown in FIG. 6) that may be located and affixed within an interior of the back pocket 60. In this configuration, the short radio 112 is shown as seated on a first or primary adjustable intermediate panel portion 22 that is part of the intermediate panel 20.

Figure 5A:
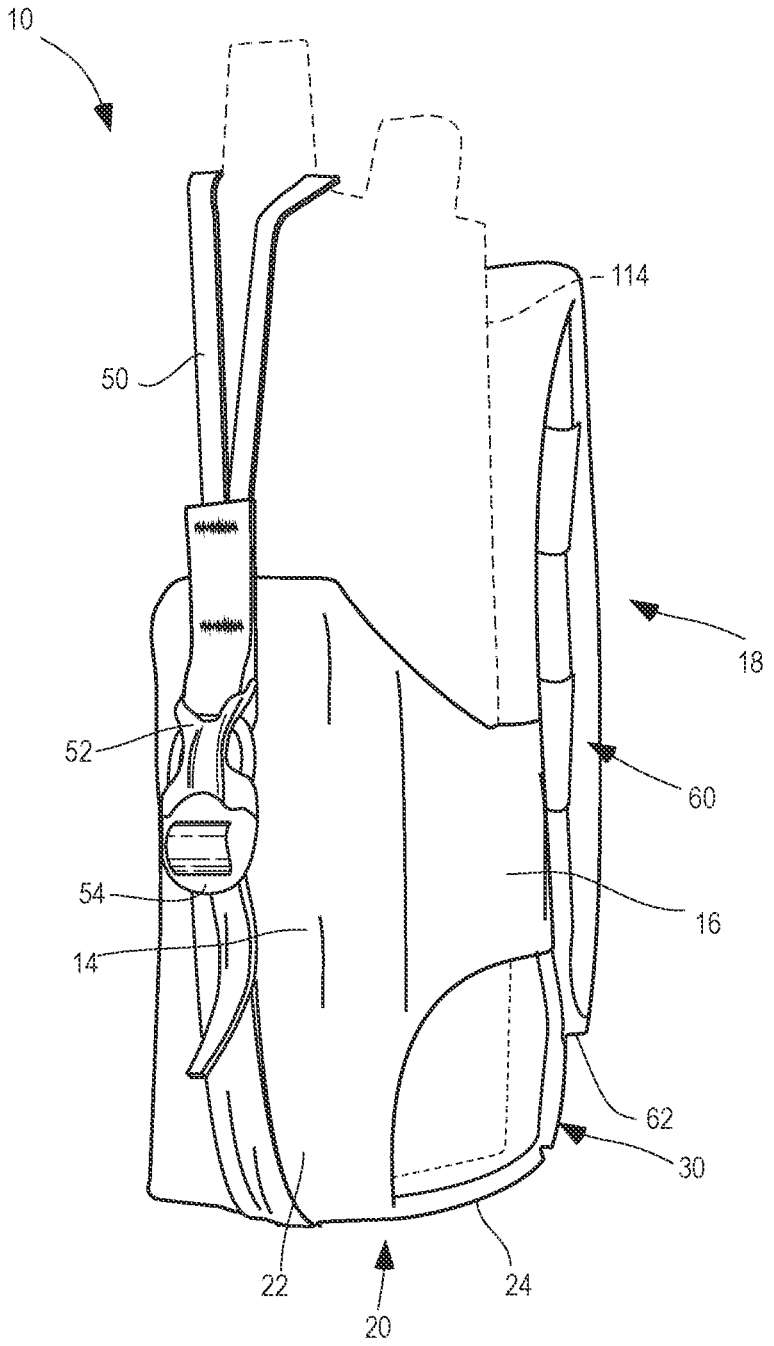
FIG. 5A is a perspective view of a universal holster device holding a tall radio device in accordance with an embodiment of the present invention.
Figure 5B:
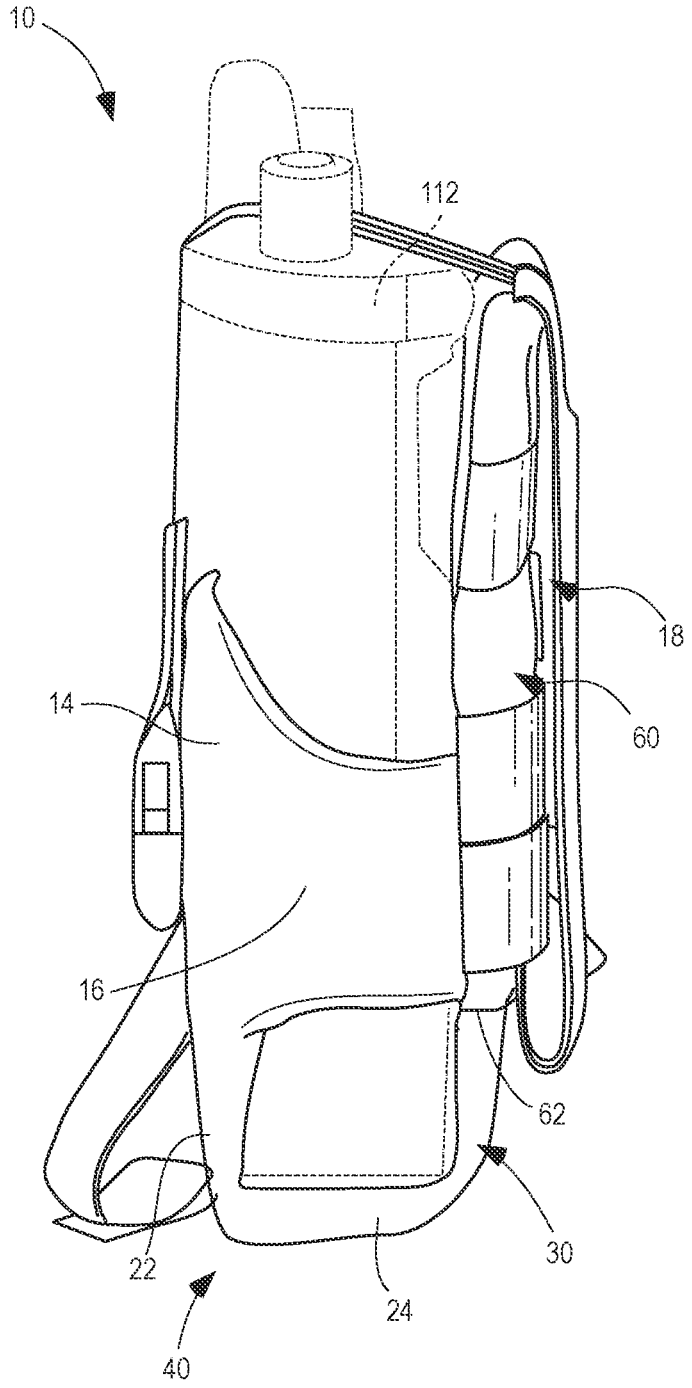
FIG. 5B is a side view of the universal holster device of FIG. 5A holding a tall radio device.

As illustrated in FIGS. 5A and 5B, the device 10 can be adjusted to a second configuration to optimally accommodate holding a tall radio 114. In this configuration, the adjustable back panel 30 can be slid downward so that the primary adjustable intermediate panel 22 now orients itself to become part of the front of the device 10 and the tall radio 114 is seated on a second or secondary adjustable intermediate panel portion 24 that now makes up at least a portion of the bottom of the device 10. This adjustment gives the device 10 a larger vertical dimension which may allow for the top of the tall radio 114 to be in generally the same position with respect to the upper end of the device 10 as was the top of the short radio 112 in the first configuration.

In the first configuration (i.e., the configuration adapted for holding shorter objects as shown in FIGS. 4A and 4B), the secondary adjustable intermediate panel 24 is located generally on the back of the device 10 and is at least partially slid into, and received within, the back pocket 60 along with the adjustable back panel 30. In the second configuration (i.e., the configuration adapted for holding taller objects as shown in FIGS. 5A and 5B), the secondary adjustable intermediate panel 24 is located generally at the bottom of the device 10, while at least a portion of the adjustable back panel 30 remains within the back pocket 60. In both configurations, the first side of the hook and loop fastener 32 is fastened to the second side of a hook and loop fastener 64 on the interior of the back pocket 60 (see sectional view in FIG. 6) in order to secure panels 22, 24, and 30 in their respective positions in each configuration. To allow for this fastening to happen in both configurations, the second side of hook and loop fastener 64 may occupy a substantial distance in the vertical direction within the back pocket 60 or may include multiple sections covering substantially enough of the vertical span of the back pocket 60 so as to allow for these adjustments.

Additionally, the first side of hook and loop fastener 32 and the second side of hook and loop fastener 64 may be interchangeably selected to be either the hook side or the loop side so long as they are configured to allow fastening to each other. That is, if the first side of the hook and loop fastener 32 is the hook side, then the second side of the hook and loop fastener 64 should be the loop side, and vice versa. It will be appreciated that the hook and loop fasteners may be VELCRO® or any other suitable material.

Figure 7A:
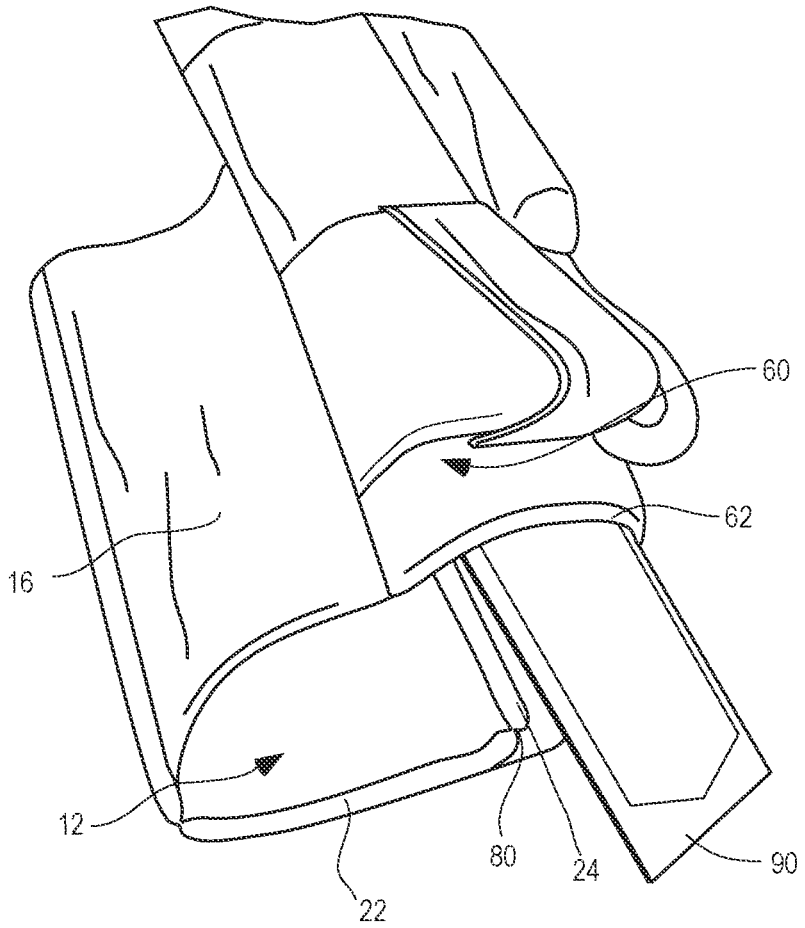
FIG. 7A is a partial perspective view of an adjuster device in a universal holster device, illustrating the holster device in a first configuration based on the position of its bottom and back panels in accordance with an embodiment of the present invention.
Figure 7B:
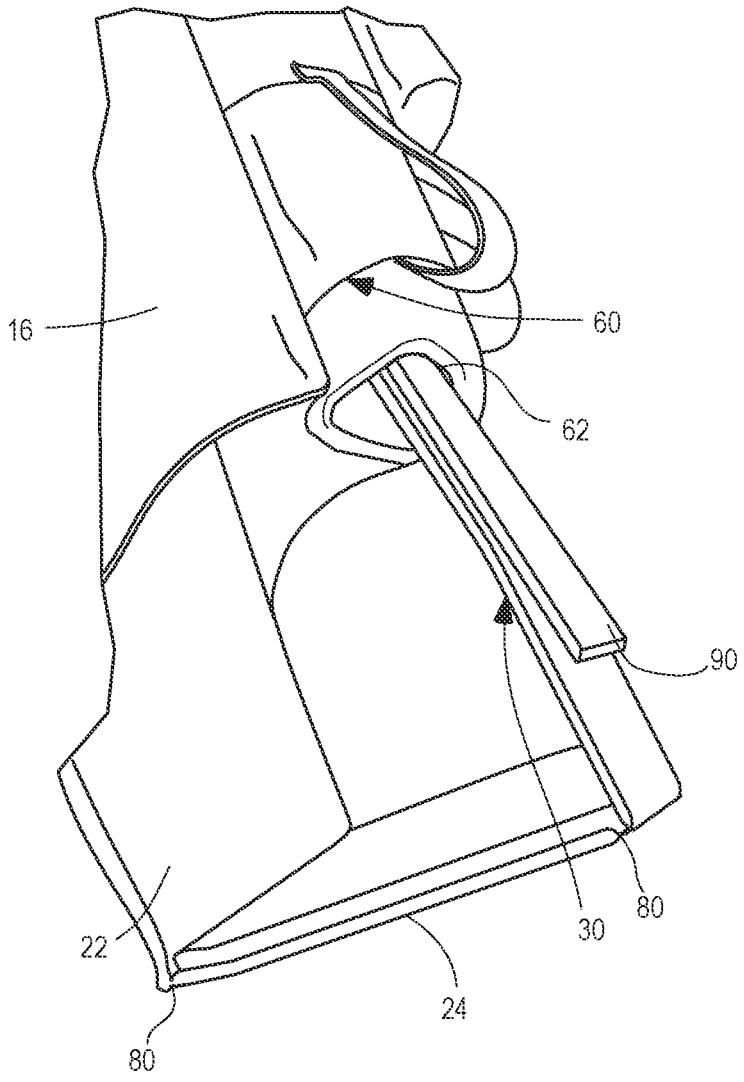
FIG. 7B is a partial perspective view of the adjuster device in a universal holster device of FIG. 7B, illustrating the holster device in a second configuration based on the position of its bottom and back panels.
Figure 8:
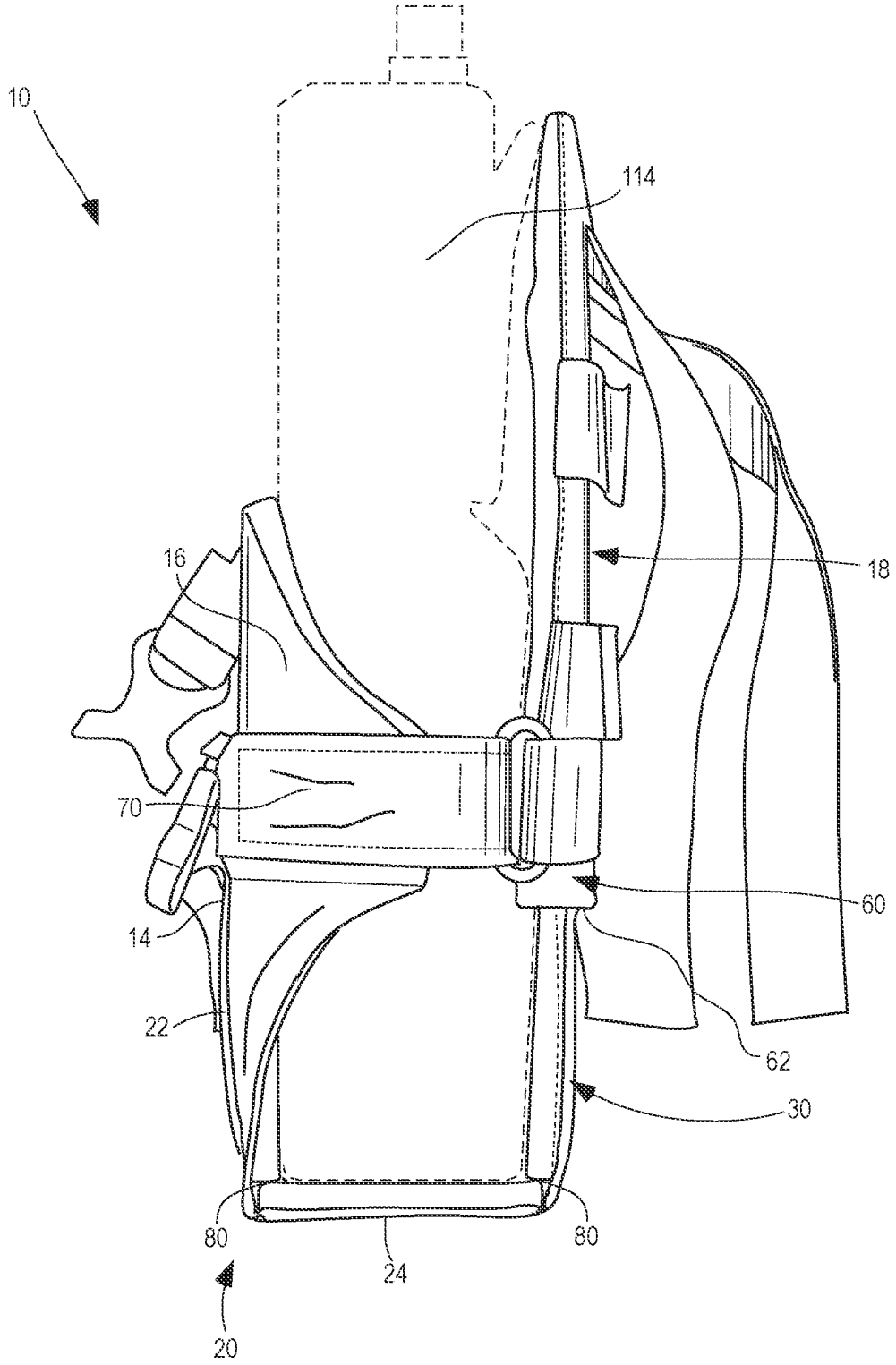
FIG. 8 is a side view of a universal holster device holding a tall radio device in accordance with an embodiment of the present invention.

In one embodiment of the invention, as best illustrated in FIGS. 6-8, one or more lateral flex lines 80 may be optionally positioned within or adjacent to intermediate panel 20 enabling the intermediate panel 20 to flex horizontally. For example, a first lateral flex line 80 may be placed between the primary adjustable intermediate panel 22 and the secondary adjustable intermediate panel 24, and a second lateral flex line 80 may be placed between the secondary adjustable intermediate panel 24 and the adjustable back panel 30. The lateral flex lines 80 may allow for easier adjusting between size configurations of the device 10. They may also allow for the intermediate panel 20 to be incrementally inserted into the back pocket 60. Each lateral flex line 80 may be created by a relief or break in the material that creates a preference in the material to form an angle at that location, or it may be created simply by a marking such as a line that enables a user to more easily see where the adjustment should ideally be positioned. In one embodiment, the flex lines 80 can be formed by sewing an outer liner of the intermediate panel 20 through an inner support material thereof or by interrupting such inner support material along the flex lines 80.

It will be appreciated that despite the foregoing descriptions referencing a first configuration and second configuration for a short radio 112 and tall radio 114, the invention is not limited to merely two configurations but accounts for any multiple of configurations to meet several different sizes of a held item. Thus, the exact positioning of the primary adjustable intermediate panel 22 and secondary adjustable intermediate panel 24 need not be in exactly the configurations contemplated above. Those are merely used for ease of understanding. Moreover, while the figures only show one or two lateral flex lines 80 per device 10, a device 10 could embody any number of flex lines to more easily facilitate a wide array of adjustments between configurations for a given device 10.

The adjustments contemplated above are facilitated by interrupting or breaking and then reaffixing the first side 32 and second side 64 of a hook and loop fastener within the back pocket 60. Because hook and loop fasteners are typically pulled apart, this breaking apart of these hook and loop fasteners is not easily done due to their positioning on the inside of the back pocket 60. Therefore, the present invention uses an adjuster 90 to slide between the first side 32 and second side 64 of the hook and loop fastener to break them apart. This adjuster 90 can be made of any material so long as it is thin and rigid enough to slide between the hook and loop portions to break them apart. One embodiment contemplates the use of plastic because it is rigid enough to break the hook and loop portions apart while still providing some amount of flexibility. For example, the adjuster 90 may be constructed of plastic, fiberglass, composite materials, laminated materials, metal, wood, or any other suitable material currently known or hereafter developed.

To make an adjustment, the adjuster 90 is slid into the back pocket 60 through the pocket opening 62 as illustrated in FIGS. 7A and 7B. With the adjuster 90 having broken the first side 32 and second side 64 of the hook and loop fastener apart and keeping them apart, the user is then able to adjust the device 10 to the desired size configuration by pushing or pulling the adjustable back panel 30 further into or out of the back pocket 60, which in turn adjusts the positioning of the adjustable intermediate panel 20. In one embodiment, as illustrated in FIG. 2, the intermediate panel 20 may include one or more indicators, marks, or lines 34 (see FIGS. 2 and 3) indicating various positions of the intermediate panel 20 relative to the back pocket 60 or pocket opening 62. Such lines 34 may permit a user to insert the intermediate panel 20 a predetermined distance into the back pocket 60 resulting in a cradle 12 that is sized for a particular size of radio 110 or other object. Once the desired size configuration is reached, the adjuster 90 can then be slid back out of the back pocket 60 and the first side 32 and second side 64 of the hook and loop fastener will reconnect and hold that configuration in place.

In one embodiment, additional width and depth adjustments are permitted by using adjustable fasteners on the side straps or panels 70 as best illustrated in FIG. 8. These adjustable side panels 70 allow for greater width and depth adjustment than is possible when using only the adjustable intermediate panel 20 and adjustable back panel 30. The adjustable side panels 70 in FIG. 8 use hook and loop fasteners, but other fasteners could achieve the same result. Moreover, while the figures show the adjustable side panels 70 completely external to the back pocket 60, one embodiment of the invention could have openings on the sides of the back pocket 60 and an additional one side of hook and loop fastener affixed on the opposite face of the interior of the back pocket 60 as to which the second side of hook and loop fastener 64 is attached. This would allow for the adjustable side panels 70 to attach inside the back pocket 60 and be adjusted in a similar fashion as to the primary adjustment contemplated of the adjustable intermediate panel 20 and adjustable back panel 30.

Various embodiments of systems, devices, and methods have been described herein. These embodiments are given only by way of example and are not intended to limit the scope of the invention. It should be appreciated, moreover, that the various features of the embodiments that have been described may be combined in various ways to produce numerous additional embodiments. Moreover, while various materials, dimensions, shapes, configurations, locations, etc. have been described for use with disclosed embodiments, others besides those disclosed may be utilized without exceeding the scope of the invention.

Persons of ordinary skill in the relevant arts will recognize that the subject matter hereof may comprise fewer features than illustrated in any of the individual embodiments described above. The embodiments described herein are not meant to be an exhaustive presentation of how the various features of the subject matter herein may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. These are only examples of what is specifically intended, and all possible combinations of numerical values between the lowest value and the highest value enumerated, are to be considered to be expressly stated in this disclosure.

As used herein, "a," "an," or "the" can mean one or more than one. For example, "an" image can mean a single image or a plurality of images.

The term "and/or" as used in a phrase such as "A and/or B" herein can include both A and B; A or B; A (alone); and B (alone). Likewise, the term "and/or" as used in a phrase such as "A, B, and/or C" can include at least the following embodiments: A, B, and C; A, B, or C; A or C; A or B; B or C; A and C; A and B; B and C; A (alone); B (alone); and C (alone).

As used herein, the term "about" when referring to a measurable value such as an amount, a temporal duration, and the like, can include variations of +/−20%, more preferably +/−10%, even more preferably +/−5% from the specified value, as such variations are appropriate to reproduce the disclosed methods and systems.

The constructions described in the accompanying materials and illustrated in the drawings are presented by way of example only and are not intended to limit the concepts and principles of the present invention. Thus, there has been shown, and described several embodiments of a novel invention. As is evident from the description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." Many changes, modifications, variations, and other uses and applications of the present construction will, however, become apparent to those skilled in the art after considering the specification and the accompanying drawings. All such changes, modifications, variations, and other uses and applications which do not depart from the spirit and scope of the invention are deemed to be covered by the invention which is limited only by the claims which follow.

What is claimed is:

1. An adjustable holster device for holding objects of different sizes, the device comprising:

an intermediate panel including a first intermediate panel portion and a second intermediate panel portion;

a back panel connected to the second intermediate panel portion;

a back pocket configured for receiving the back panel and at least a portion of the second intermediate panel portion;

a cradle adapted for receiving at least one of the objects, the cradle being at least partially defined by the intermediate panel; and a fastener having a first fastening member and a second fastening member, the first fastening member being attached to the back panel and the second fastening member being attached within the back pocket;

wherein, when the first fastening member and second fastening member are not fastened together, the back panel is configured for being selectively movable relative to the back pocket;

wherein a height of the cradle is adjustable by moving the back panel relative to the back pocket.

2. The adjustable holster device of claim 1, wherein the fastener is a hook and loop fastener having a hook member and a loop member, wherein the first fastening member is one of the hook member and the loop member and the second fastening member is the other of the hook member and the loop member.

3. The adjustable holster device of claim 2 further comprising:

an adjuster sheet configured to be selectively insertable between the hook member and the loop member to effect separation thereof and to permit the back panel to be selectively movable within the back pocket.

4. The adjustable holster device of claim 3, wherein the adjuster sheet is a thin sheet made of a rigid or semi-rigid material.

5. The adjustable holster device of claim 1 further comprising a lateral flex line.

6. The adjustable holster device of claim 5, wherein the lateral flex line is located between the intermediate panel and the back panel.

7. The adjustable holster device of claim 5, wherein the lateral flex line is located between the first intermediate panel portion and the second intermediate panel portion.

8. The adjustable holster device of claim 7, wherein the lateral flex line is constructed such that it is more flexible than a remainder of the intermediate panel.

9. The adjustable holster device of claim 7, wherein the lateral flex line is a relief in the intermediate panel such that the intermediate panel is thinner at the lateral flex line than it is in adjacent areas to the lateral flex line.

10. The adjustable holster device of claim 1 further comprising at least one visible marking on the intermediate panel or back panel that indicates to a user where the intermediate panel or back panel should be aligned with respect to another portion of the adjustable holster device to achieve a certain configuration of the cradle.

11. The adjustable holster device of claim 1 further comprising:

a side panel including a first side panel portion and a second side panel portion; and a second fastener having a first fastening member and a second fastening member, the first fastening member being attached to the first side panel portion and the second fastening member being attached to the second side panel portion;

wherein the first side panel portion and the second side panel portion at least partially overlap;

wherein, when the first fastening member and the second fastening member of the second fastener are separated, the second side panel portion is configured for being selectively movable to overlap a larger or smaller area of the first side panel portion;

wherein a depth of the cradle is adjustable by changing the amount of overlap area between the first side panel portion and the second side panel portion.

12. An adjustable holster device for holding objects of different sizes, the device comprising:

an intermediate panel including a first intermediate panel portion and a second intermediate panel portion;

a back panel connected to the second intermediate panel portion;

a back pocket configured for receiving the back panel and at least a portion of the second intermediate panel portion;

a cradle adapted for receiving at least one of the objects, the cradle being at least partially defined by the intermediate panel; and a hook and loop fastener having a hook member and a loop member, one of the hook member and loop member being attached to the back panel and the other of the hook member and loop member being attached within the back pocket;

wherein, when the hook member and loop member are separated, the back panel is configured for being selectively movable relative to the back pocket;

wherein, when the hook member and loop member are connected, the hook and loop fastener keeps the back panel in a substantially fixed position relative to the back pocket and fixes a height of the cradle.

13. The adjustable holster device of claim 12 further comprising an adjuster sheet configured to be selectively insertable between the hook member and the loop member to effect separation thereof and to permit the back panel to be selectively movable within the back pocket.

14. The adjustable holster device of claim 12 further comprising:

a lateral flex line in the intermediate panel or back panel;

wherein the lateral flex line assists a user in selectively configuring the intermediate panel between a first orientation and a second orientation.

15. The adjustable holster device of claim 12 further comprising:

a side panel; and a second hook and loop fastener having a second hook member and a second loop member, one of the second hook member and second loop member being attached to the side panel and the other of the second hook member and second loop member being attached within the back pocket;

wherein, when the second hook member and second loop member are separated, the side panel is configured for being selectively movable;

wherein a depth of the cradle is adjustable by moving the side panel.

16. The adjustable holster device of claim 12 further comprising:

a side panel including a first side panel portion and a second side panel portion; and a second hook and loop fastener having a second hook member and a second loop member, one of the second hook member and second loop member being attached to the first side panel portion and the other of the second hook member and second loop member being attached to the second side panel portion;

wherein the first side panel portion and the second side panel portion at least partially overlap;

wherein, when the second hook member and second loop member are separated, the second side panel portion is configured for being selectively movable to overlap a larger or smaller area of the first side panel portion;

wherein a depth of the cradle is adjustable by moving the side panel to change the amount of overlap area between the first side panel portion and the second side panel portion.

17. The adjustable holster device of claim 16 further comprising:

a front panel;

wherein the depth of the cradle is defined by a space between the front panel and the back pocket;

wherein side panel is attached to front panel and further indirectly connected to the back pocket such that changing the amount of overlap between the first side panel portion and the second side panel portion moves the front panel and back pocket closer together or farther apart and changes the depth of the cradle.

18. The adjustable holster device of claim 12 further comprising:

a front panel;

a first strap including a first fastener member at one end thereof; and a second strap including a second fastener member at one end thereof;

wherein the first strap is attached to an external portion of the back pocket;

wherein the second strap is attached to the front panel;

wherein at least one of the first strap and the second strap has an adjustable length;

wherein the first fastener member may be affixed to the second fastener member to further secure one of the objects within the cradle.

19. A method of adjusting a height of a cradle area of an adjustable holster device, the method comprising the steps of:

providing an adjustable holster device comprising:

an intermediate panel including a first intermediate panel portion and a second intermediate panel portion;

a back panel connected to the second intermediate panel portion;

a back pocket configured for receiving the back panel and at least a portion of the second intermediate panel portion;

a hook and loop fastener having a hook member and a loop member, one of the hook member and loop member being attached to the back panel and the other of the hook member and loop member being attached within the back pocket; and an adjuster sheet configured to be selectively insertable between the hook member and the loop member to effect separation thereof and to permit the back panel to be selectively movable within the back pocket;

inserting the adjuster sheet between the hook member and the loop member to interrupt an attachment therebetween;

adjusting the intermediate panel relative to the back pocket while the adjuster sheet is inserted between the hook member and the loop member; and removing the adjuster sheet from between the hook member and the loop member allowing the hook member and the loop member to attach together.

20. A method of claim 19, wherein the step of adjusting the intermediate panel relative to the back pocket is done so as to locate the intermediate panel to a specific position that corresponds to a configuration of the adjustable holster device that generally conforms to an object to be held by the adjustable holster device.

* * * * *